United States Patent [19]

Tsuji

[11] 4,306,979

[45] Dec. 22, 1981

[54] FOAM TYPE FIRE EXTINGUISHING AGENT FOR HYDROPHILIC COMBUSTIBLE LIQUIDS

[75] Inventor: Toshihide Tsuji, Kawasaki, Japan

[73] Assignee: Hochiki Corporation, Tokyo, Japan

[21] Appl. No.: 67,500

[22] Filed: Aug. 17, 1979

[30] Foreign Application Priority Data

Aug. 17, 1978 [JP] Japan ..... 53-99461

[51] Int. Cl.[3] ..... A62D 1/04

[52] U.S. Cl. ..... 252/3; 252/8.05; 252/307

[58] Field of Search ..... 252/3, 8.05, DIG. 11

[56] References Cited

U.S. PATENT DOCUMENTS

| | | | |
|---|---|---|---|
| 2,196,042 | 4/1940 | Timpson | 252/3 |
| 2,748,078 | 5/1956 | Perri et al. | 252/8.05 |
| 2,767,141 | 10/1956 | Ratzer et al. | 252/3 X |
| 2,895,910 | 7/1959 | Merton et al. | 252/3 |
| 3,062,878 | 11/1962 | Karabinos et al. | 252/DIG. 11 |
| 3,956,138 | 5/1976 | Crockett | 252/3 |

FOREIGN PATENT DOCUMENTS

| | | | |
|---|---|---|---|
| 51-84197 | 7/1976 | Japan | 252/3 |

*Primary Examiner*—Richard D. Lovering
*Attorney, Agent, or Firm*—Sughrue, Mion, Zinn, Macpeak and Seas

[57] ABSTRACT

A foam type fire extinguishing agent for hydrophilic combustible liquids which comprises (a) a hydroxycarboxylic acid or salt thereof represented by one of the following general formulae and/or a lactone formed in equilibrium with the corresponding hydroxycarboxylic acid:

$$HO\text{-}(HCOH)_n\text{-}COOX \quad \text{(Ia)}$$

$$H\text{-}(HCOH)_n\text{-}COOX \quad \text{(Ib)}$$

$$CH_3\text{-}(CH_2)_m\text{-}(HCOH)_n\text{-}COOX \quad \text{(Ic)}$$

$$H\text{-}(HCOH)_n\text{-}(CH_2)_l\text{-}COOX \quad \text{(Id)}$$

where X represents a hydrogen atom, an alkali metal atom, an ammonium ion, triethanolamine, diethanolamine or monoethanolamine; n represents an integer of 1 to 10; m represents zero or an integer of 1 to 5; and l represents an integer of 1 to 5;

(b) an aliphatic carboxylic acid or salt thereof represented by the following general formula:

$$R-\overset{\overset{D}{|}}{C}HCOOX \quad \text{(II)}$$

where R represents an alkyl group containing 8 to 20 carbon atoms, or an alkylene group containing 8 to 20 carbon atoms, D represents a hydrogen atom or an amino group, and X represents a hydrogen atom, an alkali metal atom, an ammonium ion, triethanolamine, diethanolamine or monoethanolamine, (c) a salt of an organic or an inorganic acid and a metal other than an alkali metal, or a metal hydroxide other than an alkali metal hydroxide, and (d) a foaming agent. This agent exhibits high foaming ability upon dilution with not only fresh water but also sea water and can generate foams excellent in both alcohol resistance and flowability and can thereby effectively extinguish fires of hydrophilic combustible liquids.

12 Claims, No Drawings

FOAM TYPE FIRE EXTINGUISHING AGENT FOR HYDROPHILIC COMBUSTIBLE LIQUIDS

BACKGROUND OF THE INVENTION

1. Field of the Invention

The present invention relates to a foam type fire extinguishing agent for hydrophylic combustible liquids. More particularly, the present invention relates to a fire extinguishing agent which exhibits high foaming ability upon dilution with not only fresh water but also sea water, which generates foams having excellent alcohol resistance and flowability and which can effectively extinguish fires of hydrophilic combustible liquids. Further, the fire extinguishing agent of the present invention possesses various characteristics in addition to those described above, such as about a neutral pH, low viscosity, a low solidifying point (−5° C. or below), largely reduced deterioration under prolonged preservation, and which is effective in extinguishing fires of hydrophilic combustible liquids even when used in dilutions of 3%.

2. Description of Prior Art

In general, when most foam type fire extinguishing agents, which have commonly been used for extinguishing fires of petroleum, are employed for extinguishing fires of so-called hydrophilic combustible liquids such as alcohols, ketones, ethers, esters and the like, no sooner does the foam generated by such fire extinguishing agents contact the burning surfaces than it melts away. Thus it is impossible to cover the burning surface with the foam and it is not possible to extinguish the fire.

Many foam type fire extinguishing agents useful for extinguishing fires of hydrophilic combustible liquids have been proposed, and they can generally be classified into the following three groups:

(1) Fire extinguishing agents of the type which contain decomposition products of natural proteins as a base material and contain metal soaps dispersed in the base material with the aid of triethanolamine or the like.

(2) Fire extinguishing agents in which metal soaps are solubilized and dispersed in synthetic surface active agents.

(3) Fire extinguishing agents which contain water soluble high polymers in large amounts and further contain surface active agents of the fluorinated aliphatic system and other foaming agents.

Fire extinguishing agents of the first group (1) are prepared by solubilizing and dispersing large quantities of water insoluble metal soaps into fire extinguishing agents with the aid of amines or the like, and stock solutions of such agents rarely have pH values around neutrality. Therefore, they are accompanied by several disadvantages. For example, containers therefor are subject to corrosion, the chemicals are dangerous to the human body, and deterioration such as precipitation and separation are likely to occur during prolonged storage. In addition, they lose their fire extinguishing ability through precipitation of the metal soaps from water solutions if they are not foamed immediately after mixing with water.

The foam generated by fire extinguishing agents of group (1) is excellent in so-called alcohol resistance (i.e., the foam does not melt upon contact with alcohols), but the generated foam is very hard and caky. Under such circumstances, the agent frequently fails because the foam cannot flow and spread over the entire burning area. Moreover dilution with sea water causes a remarkable drop in the foaming ability. Further, fire extinguishing agents of the group (1) are far from being economical because they have been made available for practical use in only 6% dilutions (The term "dilutions" is used throughout this specification in the manner in which it is used in this art. A 6% dilution is a dilution of 6 parts by volume foam liquid with 94 parts by volume water.).

On the other hand, extinguishing agents of the second group (2) possess low foaming abilities, and the alcohol resistance of the generated foam is low. Though they are on the market in a 3% dilution, large quantities of agents are required to achieve fire extinguishing because the fires cannot be put out until the burning liquids are considerably diluted by casting a large quantity of foam thereinto. Moreover, the fire extinguishing effect cannot be accomplished in case of liquids such as butanol for which the dilution effect is not so great, and in the case of liquids such as acetone which have a strong calorific force and a strong defoaming action.

The agents of the third group (3) are characterized by the addition of water soluble high polymers having high hydrating abilities, and the solutions of such water soluble high polymers cause syneresis in hydrophilic combustible liquids to result in the formation of gelatinous mat, and thereby the foam existing thereon can be protected. Fire extinguishing agents of this type are supposed to exhibit higher extinguishing power because the foam generated from them has better spreadability than the foam generated from the fire extinguishing agents of group (1). However, frequently the gelatinous mat formed inhibits the spreadability of the foam. In addition, viscosities of stock solutions of fire extinguishing agents are very high due to the addition of large quantities of water soluble high polymers. Further, the need for comparatively high concentrations of high polymers contained in water solutions (gelatinous mat cannot be formed when the concentrations of high polymers in water solutions are too low) makes it necessary to employ dilution ratios of 6% or higher in practice. Due to the high viscosity (on the order of 1000 cs or above) inherent in the stock solution of the fire extinguishing agent of the third type, bubbles arise in the course of preparation or charging, or a great change in viscosity is caused by variation in surrounding temperature. Furthermore storage of such a stock solution in a cold place is difficult due to the high solidifying point of the agent which is in the vicinity of 0° C. As described above, the fire extinguishing agents of the third type have various disadvantages. Moreover, they are very expensive though those which contain as additives fluorinated aliphatic surface active agents are on the market.

The problems which occur when conventional fire extinguishing agents are employed for fires of combustible liquids other than petroleums are summarized below:

One problem related to stock solutions of the agents in which a metal soap is dispersed in the decomposition products of natural proteins is that they are not only unstable in themselves but also attended by unavoidable precipitation of metal soaps when diluted with water at the time of practice, because metal soaps are generally insoluble in water and solvents commonly used for preparations of the stock solutions. In addition, they are also accompanied by a decrease in foaming ability when the stock solutions are diluted with sea water. Another problem related to agents which contain metal soaps dispersed in surface active agents is the inevitable technical limitation that since the addition of metal soaps causes a large drop in the foaming ability, it is necessary to restrict the addition amounts of metal soaps to low levels in order to raise the foaming ability, but if this is done the agents lose larger portions of their alcohol resisting abilities. It is, of course, almost impossible to use these agents diluted with sea water, and physical properties inherent in the stock solutions of such agents, such as solidifying point and the like, are not good and they can be little improved by the addition of large amounts of solvents. A further problem related to agents containing water soluble high polymers is physical properties and resistance to cold weather are so poor that ordinary foaming apparatuses cannot be used in the winter season and in a cold region, and special apparatuses are required to force such agents to foam.

SUMMARY OF THE INVENTION

Accordingly, one object of the present invention is to provide a novel foam type fire extinguishing agent which overcomes the above-described difficulties.

A more specific object of the present invention is to provide a novel agent for extinguishing fires of hydrophilic combustible liquids.

Another object of the present invention is to provide a novel foam type fire extinguishing agent which generates a foam having excellent alcohol resistance and flowability.

A more particular object of the present invention is to provide a novel foam type fire extinguishing agent which exhibits high foaming ability upon dilution with fresh water and also sea water.

Still another object of the present invention is to provide a foam type fire extinguishing agent having excellent storage stability (pot life) and which can be used at 3% dilutions.

The present invention provides fire extinguishing agents for hydrophilic combustible liquids which comprises (a) hydroxycarboxylic acids or salts thereof represented by the following general formulae and/or the lactones formed in equilibrium with the corresponding hydroxycarboxylic acids:

$$HO\text{-}(\text{-}HCOH)_n\text{-}COOX \quad \text{(Ia)}$$

$$H\text{-}(\text{-}HCOH)_n\text{-}COOX \quad \text{(Ib)}$$

$$CH_3(CH_2)_m(HCOH)_n\text{-}COOX \quad \text{(Ic)}$$

$$H\text{-}(\text{-}HCOH)_n(CH_2)_l\text{-}COOX \quad \text{(Id)}$$

where X represents a hydrogen atom, an alkali metal atom, an ammonium ion, triethanolamine, diethanolamine or monoethanolamine; n represents an integer of 1 to 10; m represents zero or an integer of 1 to 5; and l represents an integer of 1 to 5, (b) aliphatic carboxylic acids or salts thereof which are represented by the following general formula:

$$\begin{array}{l} \quad\;\; D \\ \quad\;\; | \\ R\text{-}CHCOOX \end{array} \quad \text{(II)}$$

where R represents an alkyl group containing 8 to 20 carbon atoms or an alkylene group containing 8 to 20 carbon atoms, D represents a hydrogen atom or an amino group, and X represents a hydrogen atom, an alkali metal atom, an ammonium ion, triethanolamine, diethanolamine or monoethanolamine, (c) metal salts of an organic or inorganic acid of metals other than alkali metals, or metal hydroxides of metals other than alkali metals, and (d) foaming agents.

DETAILED DESCRIPTION OF THE INVENTION

Hydroxycarboxylic acids suitable for use in the present invention include glyceric acid, threonic acid, arabonic acid, ribonic acid and hexonic acids such as gluconic acid, gulonic acid, idonic acid, allonic acid, altronic acid, mannonic acid, galactonic acid and talonic acid and further, galacturonic acid and heptonic acids. They may be also effective in the form of the alkali metal, ammonium and ethanolamine salts thereof. In addition, lactones formed in equilibrium with the above-described hydroxycarboxylic acids such as D-glucono-δ-lactone or D-glucono-γ-lactone for D-gluconic acid, and the like can be used. Of these acids, hydroxycarboxylic acids represented by the formulae (Ia) and (Ib) and/or the lactones formed in equilibrium with the corresponding hydroxycarboxylic acids are preferred for use in the present invention and of these the hexonic and heptonic acids are most preferred.

Although dibasic hydroxycarboxylic acids also possess similar properties to the monobasic acids illustrated above, in the case of storage in forms of stock solutions they demonstrate high viscosities and gellation takes place therein with the passage of time. Therefore, dibasic hydroxycarboxylic acids cannot meet the objects of the present invention.

Of the above-described monobasic hydroxycarboxylic acids, hexonic acids ($HOCH_2(HCOH)_4COOH$) and heptonic acids ($HOCH_2(HCOH)_5COOH$) are employed in the examples illustrated hereinafter in view of their superior results and commercial availability.

Aliphatic carboxylic acids which can be used in the present invention are saturated or unsaturated fatty acids, or α-amino aliphatic carboxylic acids having 10 to 22 carbon atoms. These are properly selected depending upon the foaming agents and solubilizing agents used in the agent of the present invention. As examples of aliphatic carboxylic acid salts which are particularly useful in the present invention, mention may be made of triethanolamine laurate, triethanolamine myristate, triethanolamine palmitate, triethanolamine stearate and triethanolamine oleate. In addition, ammonium and alkali metal salts of these fatty acids can be employed for compounding. Further, α-amino aliphatic carboxylic acids may be also employed, but they are inferior to the above saturated or unsaturated fatty acids from the economic point of view. Representative examples of the α-amino aliphatic carboxylic acid are α-amino lauric acid, α-amino myristic acid, α-amino palmitic acid and α-amino stearic acid.

The metal salts used in the present invention are salts of metals other than alkali metals. Preferred salts have high solubilities and are salts of such metal ions as $Ca^{2+}$, $Mg^{2+}$, $Al^{3+}$, $Fe^{3+}$ and the like, and inorganic or organic acid ions such as sulfuric acid, hydrochloric acid, nitric acid and lactic acid. For example, aluminium sulfate, aluminium chloride, aluminium lactate, aluminium nitrate, ferric sulfate and the like are relatively suitable for the compounding with the other components in the extinguishing agent of the present invention.

The foaming agents employed in the present invention have been conventionally compounded in foam type fire extinguishing agents commonly used for petroleum fires. They include anionic and amphoteric synthetic surface active agents and hydrolytic decomposition products of proteins. Needless to say synthetic surface active agents are preferable because when the synthetic surface active agents are used to produce stock solutions of fire extinguishing agents the resulting stock solution is stable with the lapse of time. Cationic surface active agents produced synthetically cannot be employed. Nonionic surface active agents can be used but are not desirable due to their insufficient foaming ability. For example, tween sorbitane type and cane sugar type nonionic surface active agents have relatively high foaming abilities among nonionic surface active agents, but their foaming abilities are not sufficient to make them desirable to use as the foaming agent of the present invention.

The most preferable foaming agents are alkyl or alkylene sulfates or alkyl or alkylene sulfonates of anionic surface active agents. Representative examples of anionic surface active agents are lauryl sulfate, dodecyl sulfonate, polyoxyethylene lauryl ether sulfate, octyl sulfate, etc. In addition, amphoteric surface active agents of the imidazoline type and those of betaine type also provide good results. Representative examples of imidazoline type and betaine type amphoteric surface active agents are 2-lauryl-N-carboxymethyl-N-hydroxyethyl imidazolinium betaine, lauryl betaine, stearyl betaine, etc. Considering dilution of the stock solution with sea water, polyoxyethylene alkylsulfate is the most favorable of all anionic surface active agents. In such a case, the surface active agent should have an addition number of two or more with respect to polyoxyethylene units when the alkyl moiety contains 8 to 18 carbon atoms. On the other hand, amphoteric surface active agents of imidazoline and betaine types can withstand dilution with sea water.

Suitable examples of the foaming agents used in the present invention are lauryl sulfate, dodecyl sulfonate, polyoxyethylene lauryl ether sulfate, dodecylbenzene sulfonate, octyl sulfate, lauryl betaine, stearyl betaine, 2-lauryl-N-carboxymethyl-N-hydroxyethyl imidazolinium betaine and hydrolytic decomposition products of proteins.

The carboxylic acids used in the present invention are selected depending upon foaming agents employed therewith. Anionic or amphoteric surface active agents containing a $C_{12}$ alkyl or a $C_{12}$ alkylene group have excellent high foaming abilities and when these surface active agents are used as the foaming agents, myristic acid, palmitic acid and salts thereof are suitable as the carboxylic acids. Anionic or amphoteric surface active agents containing a $C_8$ alkyl or a $C_8$ alkylene group have relatively high foaming abilities and when these surface active agents are used as the foaming agents, lauric acid and salts thereof are suitable as the carboxylic acids.

The foam type extinguisher of the present invention preferably contains about 1 to 30 wt% hydroxycarboxylic acid, about 0.2 to 15 wt% of aliphatic carboxylic acid, about 0.2 to 15 wt% metal salt or hydroxide as the metal ion and about 5 to 40 wt% foaming agent based on the total amount of the extinguishing agent.

As described above, the carboxylic acids are selected depending upon foaming agents employed in combination therewith. When surface active agents having high foaming abilities are used, lauric acid, myristic acid, palmitic acid, stearic acid, oleic acid and the like are useful as the carboxylic acids. Selection of optimum carboxylic acids depends not only upon the surface active agents used as the foaming agents but also on the hydrophilic groups and further, the type and size of hydrophobic groups contained in additives which may be present in the agent composition, such as foaming assistants, solubilizing agents, etc. which may be added to the agent as required. Taking into account the above-described various factors, the optimum combinations are selected. For example, when polyoxyethylene lauryl sulfate is employed as a foaming agent, myristic acid and palmitic acid give good results.

On the occasion that hydrolytic decomposition products of proteins are used as foaming agents, it is desirable to add synthetic surface active agents as foaming assistants and solubilizing agents. As synthetic surface active agents employed as solubilizing agents, mention may be made of agents selected from the above-described foaming agents.

As additives employed for the purpose of the improving the stability of the foam generated, higher alcohols (preferably having 8 to 18 carbon atoms) such as lauryl alcohol, myristyl alcohol and the like and water-soluble amines are useful. Generally the higher alcohols are employed in an amount of 0.5 to 5 wt% based on the total amount of the fire extinguishing agent and the amines are used in an amount of 1 to 10 wt% based on the total amount of the fire extinguishing agent.

Water soluble high polymer may be added to the composition to enhance alcohol resistance, as examples thereof, alginates, alginic acid polyglycol ester, pectin, D-galactomannan-containing materials, scleroglucan, polyacrylates, polyacrylamide, A G gum, gum arabic, carboxymethyl cellulose, carboxymethyl starch, starch, etc. are useful. The addition amount of such a high polymer is determined by balancing the hydrating power thereof and the increase in the viscosity their addition produces, but the high polymer is generally used in an amount of 0.01 to 5 wt%.

Organic solvents may be added to the composition to further improve the stability of the stock solution and is desirable because it attends advantages from the preparation and characterists points of views. For example, a decrease in viscosity prevents bubble generation, lowers the solidifying point, etc. Examples of such organic solvents include high flash point solvents such as ethylene glycol, ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, dimethyl formamide, 3-methyl-3-methoxybutanol and so on. The organic solvents may be used in an amount of 5 to 40 wt%.

Furthermore, in addition to the above-described compounding additives, it is effective to add urea to the composition as a freezing point depressing agent and, further, it is effective to add a rust preventing agent and an antiseptic.

Preferred embodiments of the present invention are illustrated by the following Examples. Unless otherwise indicated all parts, percentages, etc. are by weight.

EXAMPLE 1

A foam type fire extinguishing agent was prepared by compounding the following ingredients in the amounts shown:

| | |
|---|---|
| Polyoxyethylene Lauryl Ether Sulfate Triethanolamine Salt | 20 wt % |
| Triethanolamine Palmitate | 2 wt % |
| Triethanolamine Gluconate | 10 wt % |
| Aluminium Sulfate | 1 wt % |
| Lauryl alcohol | 1 wt % |
| Ethylene Glycol Monobutyl Ether | 25 wt % |
| Water | 41 wt % |

The thus obtained agent appeared a transparent light yellow color and had a pour point of −16° C., a viscosity of 9 cs (20° C.) and no flash point.

EXAMPLE 2

A foam type fire extinguishing agent was prepared by compounding the following ingredients in the amounts shown:

| | |
|---|---|
| Lauryl Dimethyl Betaine | 15 wt % |
| Triethanolamine Myristate | 2.5 wt % |
| Triethanolamine Gluconate | 10 wt % |
| Aluminium Sulfate | 1 wt % |
| Lauryl Alcohol | 0.5 wt % |
| Ethylene Glycol Monobutyl Ether | 25 wt % |
| Water | 46 wt % |

The thus obtained agent had the following characteristics:

| | |
|---|---|
| Appearance: | Colorless and transparent |
| Pour Point: | −15° C. |
| Viscosity: | 11 cs (20° C.) |
| Flash Point: | none |

EXAMPLE 3

A foam type fire extinguishing agent was prepared by compounding the following ingredients in the amount shown:

| | |
|---|---|
| Hydrolytic decomposition products of proteins[1] | 67.7 wt % |
| Polyoxyethylene Lauryl Ether Sulfate Triethanolamine Salt | 10 wt % |
| Triethanolamine Palmitate | 1.5 wt % |
| Sodium Heptonate | 10 wt % |
| Aluminium Sulfate | 0.8 wt % |
| Ethylene Glycol Monobutyl Ether | 10 wt % |

[1]3% type stock solutions of protein foam fire extinguishing agents for petroleums.

The thus obtained agent had the following characteristics:

| | |
|---|---|
| Appearance: | Brownish and transparent |
| Pour Point: | −10° C. |
| Viscosity: | 19 cs (20° C.) |
| Flash Point: | none |

EXAMPLE 4

A foam type fire extinguishing agent was prepared by compounding the following ingredients in the amounts shown:

| | |
|---|---|
| Polyoxyethylene Lauryl Ether Sulfate Triethanolamine Salt | 20 wt % |
| Triethanolamine Palmitate | 1.5 wt % |
| Triethanolamine Gluconate | 10 wt % |
| Aluminium Sulfate | 0.7 wt % |
| Triethanolamine Alginate | 0.5 wt % |
| Ethylene Glycol | 25 wt % |
| Ethylene Glycol Monobutyl Ether | 5 wt % |
| Water | 37.3 wt % |

The thus obtained agent had the following characteristics:

| | |
|---|---|
| Appearance: | Light yellowish and transparent |
| Pour Point: | −5° C. |
| Viscosity: | 100 cs (20° C.) |
| Flash Point: | none |

Comparisons of various physical properties of the fire extinguishing agents of the present invention (wherein the synthetic surface active agent was used) with conventional foam type fire extinguishing agents for hydrophilic combustible liquids (a protein system and water soluble high polymer system) are presented in Table 1 below.

TABLE 1

| Sample | Appearance | Viscosity (at 20° C.) | Pour Point | pH | Dilution Ratio | Stability[3] | Price Ratio[4] |
|---|---|---|---|---|---|---|---|
| Example 1 | Transparent Light Yellow | 9 cs | −16° C. | 7.0 | 3% | 15 years or longer | 1 |
| Comparison 1[1] | Opaque Light Yellow | 1230 cs | −2° C. | 7.6 | 6–9% | Not Clear | 5 |
| Comparison 2[2] | Blackish Brown | 48 cs | −20° C. | 10.0 | 6% | 2–3 years | 2 |

Notes:
[1]a water soluble high polymer and a fluorinated aliphatic surface active agent.
[2]a decomposition product of a natural protein as a base component compounded with a metal soap
[3]as a stock solution
[4]based on the agent per unit volume of water solution.

In comparison 2 precipitation took place with the passage of time.

Experiments were also carried out to examine the abilities of the foams to extinguish fires of hydrophilic combustible liquids and the foaming abilities of the above Examples. The results obtained are illustrated in the following Table 2.

TABLE 2

| Agent | Burning Liquid | Water[3] | Dilution Ratio | Atmospheric Temperature | Solution Temperature | Expansion Rate[1] | 25% Drainage Time[2] |
|---|---|---|---|---|---|---|---|
| Example 1 | Methanol | Fresh | 3% | 31° C. | 20° C. | 8.7 | 5 min 21 sec |
| Example 2 | Methanol | Fresh | 3% | 31.5° C. | 20° C. | 8.8 | 4 min 5 sec |
| Example 3 | Methanol | Fresh | 3% | 31° C. | 20° C. | 7.1 | 3 min 20 sec |
| Example 4 | Methanol | Fresh | 3% | 29.5° C. | 20° C. | 8.5 | 5 min 42 sec |
| Example 1 | Methanol | Sea | 3% | 31.5° C. | 20° C. | 9.2 | 5 min 24 sec |
| Example 1 | Acetone | Fresh | 3% | 31° C. | 20° C. | 8.7 | 5 min 33 sec |
| Example 1 | n-Butanol | Fresh | 3% | 31.5° C. | 20° C. | 8.7 | 5 min 37 sec |
| Comparison 1 | Methanol | Fresh | 6% | 29.5° C. | 20° C. | 5.6 | 7 min 30 sec |
| Comparison 1 | Acetone | Fresh | 6% | 31° C. | 20° C. | 5.6 | 7 min 30 sec |
| Comparison 2 | Methanol | Fresh | 6% | 31° C. | 20°C. | 7.6 | 5 min 13 sec |
| Comparison 2 | n-Butanol | Fresh | 6% | 31.5° C. | 20° C. | 7.6 | 5 min 20 sec |

| Agent | Pre-Burning Time | Extinguishing Time | All Foam Releasing Time | Reburning Time | Foam Blanket Thickness |
|---|---|---|---|---|---|
| Example 1 | 1 min | 41 sec | 5 min | put out immediately | 18 cm |
| Example 2 | 1 min | 45 sec | 5 min | put out immediately | 14 cm |
| Example 3 | 1 min | 45 sec | 5 min | put out immediately | 16 cm |
| Example 4 | 1 min | 42 sec | 5 min | put out immediately | 17 cm |
| Example 1 | 1 min | 41 sec | 5 min | put out immediately | 19 cm |
| Example 1 | 1 min | 1 min 10 sec | 5 min | put out immediately | 15 cm |
| Example 1 | 1 min | 1 min 15 sec | 5 min | put out immediately | 20 cm |
| Comparison 1 | 1 min | 1 min 30 sec | 5 min | Spread to 13 cm (diameter) | 9 cm |
| Comparison 1 | 1 min | 2 min 40 sec | 5 min | Spread to 20 cm (diameter) | 7 cm |
| Comparison 2 | 1 min | 2 min 40 sec | 5 min | Spread to 17 cm (square) | 14 cm |
| Comparison 2 | 1 min | Not Extinguished | 5 min | — | — |

[1]ratio of volume of foam formed to volume of solution used.
[2]rate at which solution drains from foam
[3]used for dilution A standard foaming nozzle employed for testing extinguishing agents utilizing synthetic surface active agent foams, as described in the Ordinance No. 26 of the Ministry of Home Affairs (Japan) and a pick-up apparatus set before the foaming nozzle were used in combination for testing the fire extinguishing agents prepared in Examples 1 to 4 and Comparison 2. In testing the fire extinguishing agent of Comparison 1, premixing was performed using the standard foaming nozzle for testing aqueous foam type fire extinguishing agents, which nozzle is also described in Ordinance No. 26 described above. These nozzles were used at an output pressure of 7 $Kg/cm^2$ and output rate of 10 l/min.

The combustion cell in which the liquid to be burned was placed had a base area of 1.415 m×1.415 m≃2 $m^2$ and the depth of 0.3 m. The cell was filled with 100 l of liquid to be burned in each of experiments.

25% Drainage time in Table 2 is the time it takes 25% by weight the water solution to drain from the foam.

The reburning test was performed as follows: A fluid was ignited in a combustion cell and a foam was cast on the fluid over a period of 5 minutes. 15 Minutes later a square pipe having a base area of 15 cm×15 cm was thrust in the center of the combustion cell and the foam on the surface was removed from the center of the pipe to expose the liquid surface to air. The exposed liquid surface was set on fire and burned for 30 sec. Then, the square pipe was quickly removed. After 5 minutes, the area still burning was measured and the flame resistance and flowability of foam were observed. The foams generated by the fire extinguishing agents prepared in accordance with the present invention covered the burning surface immediately after removal of the pipe and rapidly extinguished the fire. Such a result showed that the flowability of the foam generated in the present invention is maintained for a long time. Thus, the sealing powers of the agents of the present invention are superior to those in Comparisons 1 and 2.

The thickness of foam blanket was measured at the time of the reburning test.

As apparent from various physical properties, for example, pour point, viscosity, pH value and so on, inherent in each of the fire extinguishing agents prepared in Examples of the present invention; comparisons of various abilities attained by the present agents with those attained by conventional fire extinguishing agents for hydrophilic combustible liquids; and further, experimental results of fire extinguishing against fires caused by hydrophilic combustible liquids; the foam type fire extinguishing agents of the present invention have excellent physical properties and pot life, are very efficient even at 3% dilution, have superior alcohol resistance, fire extinguishing power and reburning preventing ability, both fresh water and sea water can be used for dilution of the stock solution, the agent of the present invention can be prepared at a low price, etc.

While only certain preferred embodiments and practices of the present invention have shown and described, it will be understood that these embodiments and practices are merely for the purpose of illustration and description and that various other forms may be devised within the scope of this invention, as defined in the appended claims.

What is claimed is:

1. A foam type fire extinguishing agent for hydrophilic combustible liquids which comprises water and as active ingredients (a) about 1 to 30 wt% of a hydroxycarboxylic acid or salt thereof represented by one of the following general formulae and/or a lactone formed in equilibrium with the corresponding hydroxycarboxylic acid:

$$HO\text{-}(HCOCH)_n COOX \quad \text{(Ia)}$$

$$H\text{-}(HCOH)_n COOX \quad \text{(Ib)}$$

$$CH_3\text{-}(CH_2)_m(HCOH)_n COOX \quad \text{(Ic)}$$

$$H\text{-}(HCOH)_n(CH_2)_l COOX \quad \text{(Id)}$$

where X represents a hydrogen atom, an alkali metal atom, an ammonium ion, triethanolamine, diethanolamine or monoethanolamine; n represents an integer of 1 to 10; m represents zero or an integer of 1 to 5; and l represents an integer of 1 to 5, (b) about 0.2 to 15 wt% of an aliphatic carboxylic acid or salt thereof represented by the following general formula:

$$R-\overset{\overset{D}{|}}{C}HCOOX \quad \text{(II)}$$

wherein R represents an alkyl or alkylene group containing 8 to 20 carbon atoms, D represents a hydrogen atom or an amino group, and X represents a hydrogen atom, an alkali metal atom, an ammonium ion, triethanolamine, diethanolamine, or monoethanolamine, (c) about 0.005 to 5 wt% of a salt of an organic or an inorganic acid and a metal other than alkali metal or a metal hydroxide other than alkali metal hydroxide, and (d) about 5 wt% to 40 wt% of an anionic or amphoteric synthetic surface active agent, or the hydrolytic decomposition product of a protein as a foaming agent.

2. The foam type fire extinguishing agent of claim 1, wherein said hydroxycarboxylic acid is selected from the group consisting of glyceric acid, threonic acid, arabonic acid, ribonic acid, hexonic acids, galacturonic acid and heptonic acids, salts thereof and lactones formed in equilibrium therewith.

3. The foam type fire extinguishing agent of claim 2, wherein said hydroxycarboxylic acid is hexonic acids, heptonic acids, salts thereof or lactones formed in equilibrium therewith.

4. The foam type fire extinguishing agent of claim 1, wherein said aliphatic acid or salt thereof is selected from the group consisting of triethanolamine laurate, triethanolamine myristate, triethanolamine palmitate, triethanolamine stearate and triethanolamine oleate.

5. The foam type fire extinguishing agent of claim 1, wherein said aliphatic acid or salt thereof is an $\alpha$-amino aliphatic carboxylic acid.

6. The foam type fire extinguishing agent of claim 1, wherein said metal salt or hydroxide is a salt or a hydroxide of $Ca^{++}$, $Mg^{++}$, $Al^{+++}$, $Fe^{+++}$.

7. The foam type fire extinguishing agent of claim 6, wherein said metal salt is selected from the group consisting of aluminium sulfate, aluminum chloride, aluminum lactate aluminum nitrate and ferric sulfate.

8. The foam type fire extinguishing agent of claim 1, wherein said foaming agent is an alkyl sulfate, alkylene sulfate, alkyl sulfonate or alkylene sulfonate anionic surface active agent.

9. The foam type fire extinguishing agent of claim 1, wherein said foaming agent is a imidazoline or betaine, amphoteric surface active agent.

10. The foam type fire extinguishing agent of claim 1, wherein said fire extinguishing agent is diluted to a concentration of about 1.5% to 10% by volume with water.

11. The foam type fire extinguishing agent of claim 10, wherein said water is fresh water.

12. The foam type fire extinguishing agent of claim 10, wherein said water is sea water.

* * * * *